US006254938B1

(12) United States Patent
Pranevicius et al.

(10) Patent No.: US 6,254,938 B1
(45) Date of Patent: Jul. 3, 2001

(54) SPRAYING METHOD FOR APPLYING A POROUS COATING TO A SUBSTRATE

(75) Inventors: Liudvikas Pranevicius; Rimantas Pakamanis, both of Kaunas (LT)

(73) Assignee: LTU, LLC, Escondido, CA (US)

( * ) Notice: Subject to any disclaimer, the term of this patent is extended or adjusted under 35 U.S.C. 154(b) by 0 days.

(21) Appl. No.: 09/403,151

(22) PCT Filed: Apr. 20, 1998

(86) PCT No.: PCT/US98/07800

§ 371 Date: Jan. 21, 2000

§ 102(e) Date: Jan. 21, 2000

(87) PCT Pub. No.: WO98/48071

PCT Pub. Date: Oct. 29, 1998

(30) Foreign Application Priority Data

Apr. 21, 1997 (LT) ..... 97-071

(51) Int. Cl.[7] ..... C23C 4/06

(52) U.S. Cl. ..... 427/453; 427/452; 427/455; 427/456

(58) Field of Search ..... 427/447, 453, 427/455, 456, 452

(56) References Cited

U.S. PATENT DOCUMENTS

| | | | | |
|---|---|---|---|---|
| 4,238,233 | | 12/1980 | Yamada et al. | 75/146 |
| 4,772,514 | * | 9/1988 | Neufuss et al. | 428/408 |

FOREIGN PATENT DOCUMENTS

| | | | |
|---|---|---|---|
| 4102590 | | 8/1991 | (DE) . |
| 0537871 | | 4/1993 | (EP) . |
| 1384889 | | 2/1975 | (GB) . |
| 56-078450A | | 6/1981 | (JP) . |
| 5-9004 | * | 1/1993 | (JP) . |
| 2021389 | | 4/1991 | (RU) . |
| 2026890 | | 4/1991 | (RU) . |
| 2049827 | | 9/1991 | (RU) . |
| 1528810 | | 1/1988 | (SU) . |

* cited by examiner

*Primary Examiner*—Katherine A. Bareford
(74) *Attorney, Agent, or Firm*—Brown, Martin, Haller & McClain LLP

(57) ABSTRACT

A method for applying a porous coating incorporating a tricomponent powder mixture deposited on a hard substrate (i.e. metallic or ceramic) by plasma spraying. The coating has high adhesion strength to the substrate, with outstanding thermo-mechanical characteristics and with good resistane to thermal or mechanical action. The mixure includes aluminum oxide and/or titanium oxide powder and glass powder as the coating's microstructure forming materials; aluminum and/or titanium power metal binder and aluminum hyroxide and/or titanium hydroxide powder as a material assuring the formation of coating's microstructure. Plasma spraying includes passing the powder through the plasma beam, simultaneously melting of the metal oxide, partially alloying components into separate plasma beam zones—the hydroxide to the colder zone, and the metal to the hotter zone. The aluminum particles reach the substrate first and develop the adhesion of the sprayed layer to the substrate.

17 Claims, No Drawings

SPRAYING METHOD FOR APPLYING A POROUS COATING TO A SUBSTRATE

This is a national stage application of PCT/US98/07800, filed Apr. 20, 1998.

BACKGROUND OF THE INVENTION

This invention is about the techniques used in producing compositional coatings, when the coating is formed by spraying molten materials onto a substrate and when such coatings are employed in various equipment manufacturing, energetics, metallurgical and other areas to protect various details and products from corrosion, gas erosion and heat and to impart new properties to these parts. Such compositional coatings can be used as a substrate for application of other coatings, such as polymer coatings, or as a substrate for saturation with various mixtures, including catalytic compounds.

Techniques of applying protective coatings over metallic or ceramic surfaces by thermal gas spraying, employing compositions consisting of aluminum compounds are known. The most widely known technique to form compositional coatings is the use of aluminum powder consisting of aluminum oxide (see "Metallic and Ceramic Coatings: Production, High Temperature Properties and Application", M. G. Hocking, V. Vasantasree and P. S.Sidky, Materials Department, Imperial College, 1990, London.). As a rule, gaseous thermal spraying of ceramic coatings is carried out over previously deposited metallic precoat.

A deposition of aluminum precoat, which assures high anodic characteristics and a high resistance to erosion and corrosion is known (U.S. Pat. No. 4,238,233, TKP C 22 C21/10, 1981). An Al-Zn-Mg coating with indium, bismuth and tin additives is deposited on the inner surfaces of pipes and assures their cathodic protection.

A technique forming wear resistant coatings is known (see SSSR Author Certificate No. 2026890, TKP C 25 D, 1992), which includes the deposition of the main coating based on aluminum and containing Al,Cu,Mg,Mn (close to the composition of the alloy D 16), which is then oxidized by microarc in an alkaline electrolyte over a precoat of an alloyable system of Zn-Cu-Al-Ni-B alloy. This technique allows to improve the coating's adhesion strength to the substrate and simultaneously increases its wear resistance.

A plasma spraying process of ceramic coatings is known (see SSSR Author Certificate No. 2021389, TKP C 25 D 11/02, 1994) in which a plasma spray deposits a precoat (elastic nickel alloy with chromium and aluminum-nichrome) of a 0.2 mm thickness onto a metallic substrate and over this precoat a ceramic coating is deposited, employing various powder blends: partially stabilized zirconium dioxide, aluminum oxide, titanium oxide, chromium oxide and by heating such blends to a temperature of 150–200° C., onto a substrate surface which has been preheated to a temperature of up to 1300° C. In addition a coating of ceramic particles at 20–80° C. is sprayed over the precoat. This technique allows to substantially improve the thermal fatigue of the product.

The techniques mentioned above are complex, requiring a high amount of labor and a number of additional labor consuming operations: precoat deposition, oxidation and continuous temperature control of the substrate and the coating.

A technique in obtaining a multilayer coating is known (see SSSR Author Certificate No. 2049827, TPK C 23 C 4/00, 1995), encompassing spraying of the coating in the inert gas and disassociated hydrogen atmosphere. In this case, a precoat of Al-Ni powder is sprayed, which in the presence of inert gases and hydrogen ions forms hydrated aluminum oxide structures. The main coating is applied employing such powder, or the blends based on aluminum or nickel and chemically inert additives with a laminar structure, such as aluminum nitride or carbon. The coating obtained in this manner has in its composition aluminum, hydrated aluminum oxide species and boron nitride or carbon additives. The latter act as solid lubricants and assure the resistance to wear. A polymeric coating is applied over the coating prepared in this manner. Hydrated aluminum oxide types formed during the spraying improve the corrosion resistance.

It must be pointed out, however, that the coating obtained by the technology described above, is quite expensive, because of the large number of intermediate operations and expensive materials used in spraying, for example aluminum-nickel powder. In addition, on the basis of the above technology, such coating cannot have a sufficiently high resistance to wear and a sufficiently high porosity, which makes it unsuitable as a substrate for later impregnation with various mixtures i.e. the coating is not universally useful.

The method in obtaining a catalytic carrier based on intermediate aluminum hydroxide phases and Э-phase is known, where the chemical reaction is carried out on a ceramic matrix surface in aluminate, silicate and sodium sulfate solutions at pH 10.5–11.5, followed by later reduction of silicon containing aluminum hydroxide from the solution (European Patent No. EP 537871, 1994).

The main feature of this method is the high uniformity level of the deposited coating, the main disadvantage is that a reliable adhesion level between the catalyst carrier and the ceramic substrate is not obtained.

A method to deposit a catalyst carrier to steel or aluminum sheets is known (Japanese Patent No. 56-078450, 1981). The technique includes spraying at high temperature of an aqueous suspension containing glass slag, metal oxide catalyst, and also silicon oxide and/or aluminum oxide.

It is clear that introduction of glass slag into the spraying composition is to develop a free surface and to form a specific macrostructure, which together with the microstructure of the catalytic coating, must assure the optimum combination of the catalytic properties at changing conditions. However, as demonstrated in practice, the adhesion strength of such compositions obtained by spraying aqueous suspension to the substrate is not high and does not assure a reliable performance at adverse conditions.

A method is known for depositing plasma coatings (see SSSR Author Certificate No. 1528810, TPK C 23 C 4/04/1989) by employing powder mixtures: aluminum oxide and metallic titanium (1 5–60%) as a metallic binder. This method allows to obtain coatings resistant to abrasive wear. The porosity of such coating is 8–11 %, cohesive strength 9–10 Mpa. However, if such coating is to be universally useful aced for many applications, including as a precoat for other coatings, the problem of its adhesion strength arises: from one side with the substrate and from the other side with the coating which is subsequently applied to the surface of this precoat. As indicated by experimental work in this area, the solution of this problem requires that intermediate layer (precoat) must have, firstly, a thermal expansion coefficient (t.e.c.) as close as possible to the t.e.c. of the substrate and, secondly, must have a maximum integration into the structure i.e. the atoms of the coating material must form metallic bonds with the atoms of the substrate material. If the first condition can be easily met by selection of the material for the plastic bond, a metal of t.e.c. close to that of the substrate material (titanium in this case), the condition of a high degree of integration is fulfilled only under condition that alloy type of compounds are formed at the interface between the precoat and the substrate. During the plasma spraying, similar conditions can be realized by carrying out a high temperature treatment after spraying; in addition the temperature interval on heating must assure an effective bidirectional diffusion of the atoms from the precoat and from the substrate. Since such temperatures are high (above 1000° C.), usually a noticeable degradation of such coating is observed, which is characterized by anomalous growth of grains, high liquidization and considerable oxidation at its edges. Such reheating is not anticipated in the invention under discussion, and even if it were anticipated, the previously mentioned detrimental results would come up.

In order to assure a good adhesion of the precoat with the surface coating being deposited over it, the precoat must have a well developed surface, the relative free surface in this case should be no less than 10 sq.m/g (that means that 1 gram of the coating must have 10 sq.m. total surface), which assures a good adhesion of the sprayed coating. However, by calculating the relative free surface from the claimed porosity (about 10%), it is shown that it does not exceed 1 sq.m/g, which is not sufficient.

Therefore, by using this invention it is not possible to obtain a coating which assures a high adhesion to the substrate and simultaneously a high adhesion with the coatings deposited on its surface.

SUMMARY OF THE INVENTION

The purpose of the proposed invention is to obtain a universal porous coating applied by gas thermal spraying method onto a hard substrate (i.e. metallic or ceramic) with a high adhesion strength to the substrate, with outstanding thermo-mechanical characteristics and with good resistance to thermal or mechanical action. In order to obtain such porous coating, the sprayed coating must be dense (from the side of the substrate), in order to assure a good adhesion with the substrate and it must have high thermo-mechanical characteristics and at the same time the sprayed coating must have a high porosity (at its surface) in order to assure its special, including catalytic, properties. These opposing requirements can be resolved by selecting a specific chemical composition of the sprayed powder and an original spraying technology.

We are disclosing a spraying technique of tricomponent powder mixture consisting of aluminum hydroxide powder, silicate glass powder, and aluminum powder.

DETAILED DESCRIPTION OF THE PREFERRED EMBODIMENT

In this model composition, metallic aluminum acts firstly as a metallic subcoating, assuring a good adhesion of the sprayed coating with the substrate and secondly it acts providing a metallic bonding for the particles of the porous sprayed surface.

Silicate glass powder assures the formation of the microstructure of the sprayed coating. By spraying silicate glass powder, the partial melting of the particle surface must take place in order to obtain a reliable adhesion to sprayed aluminum on one side and to the aluminum hydroxide powder on the other side, which is deposited on the surface compositional layer, consisting of molten aluminum and glass particles.

Aluminum hydroxide powder acts as a material which assures obtaining a highly developed porous surface ceramic coating based on aluminum oxide (i.e assuring the formation of coating's microstructure). This can be realized by the thermal aluminum hydroxide decomposition (520–600° C.) according to this reaction:

$$2\ Al\ (OH)_3 = Al_2O_3 + 3H_2O \qquad (I)$$

In order to obtain a porous coating it is required that the thermal decomposition reaction of aluminum hydroxide take place on already sprayed coating surface and that hydroxide particles are firmly fixed in that layer. This can be achieved when the plasma spraying process is successful in avoiding the disassociation of hydroxide particles in the plasma stream (at a temperature of 5000–8000° C.). Therefore, in order to increase its affinity to aluminum, it is important to assure a partial alloying of the hydroxide particles with the surface.

Therefore, a model of the composition plasma spraying process requires passing the powder through the plasma beam, simultaneously melting of aluminum powder, partially alloying the glass powder surface, and preventing the complete thermal decomposition of aluminum hydroxide particles.

This is achieved by directing the powder into separate plasma beam zones—aluminum hydroxide is directed to the colder zone, metallic aluminum to the hotter zone.

In addition, it must be assured that in the spraying process the aluminum particles reach the substrate first, in order to develop the adhesion of the sprayed layer to the substrate. This is obtained by selecting a fractional composition of the sprayed powder. For example, aluminum and silicate glass particles usually have a higher mass and therefore achieve a greater velocity when moving through the plasma beam, which assures their reaching the surface of the sprayed substrate first.

In this way, a compositional layer is formed during the spraying process, which consists of aluminum, molten in the plasma beam and forming an elastic sublayer bonded to the substrate's surface. Into this layer glass particles are incorporated which are partially melted at the surface and therefore strongly adhere to the layer. And finally, aluminum hydroxide particles, which remained undecomposed during the process of passing through the plasma beam, are incorporated into the surface of this layer.

The coating obtained in this manner is not the final product, because firstly it is not porous, and secondly its surface does not meet the requirements of special coatings according to the phase composition (such as using the coating for catalysis, the surface should be $\gamma$ and $\theta$—modifications of aluminum oxide), and thirdly the remaining thermal stresses (the result of plasma spraying process) are high. The required physico-chemical properties of the sprayed compositional coatings are obtained by carrying out a thermal treatment in the oxidizing atmosphere, mainly air.

Aluminum oxide is formed simultaneously on aluminum subcoating according to the reaction:

$$4\ Al + 2\ O_2 = 2\ AL_2O_3 \qquad (II)$$

On the glass/aluminum interfacial surface (i.e over the glass particles included into the aluminum sublayer) at temperature range 520–580° C. (*Chemistry of Glass,* A. A. Aplen, publisher "Khimija", Leningrad, 1970), the aluminum oxidation and silicon reduction from its oxide take place according to the reaction:

$$3\ SiO_2+4\ Al=3\ Si+2\ AL_2O_3 \quad (III)$$

The reaction (III) is of an autocatalytic character. The formation of aluminum oxide crystallization centers take place at the microcracks which are located on the surface of glass particles (as a result of thermal spraying) (*Diffusional Welding of Glass and Ceramics with Metals,* V. A. Bachin, publisher Mashinostroyeniye, Moscow, 1986). The specific usefulness of this process is the removal of thermal stresses in glass particles and healing of the microcracks during the proceeding of reaction (III).

And finally, during the thermal process when the decomposition of aluminum hydroxide in a temperature range of 480–660° C. occurs, the formation of aluminum hydroxide with a highly developed microporous surface takes place according to the reaction (I).

In this way, a required chemical and phase composition is obtained on the surface of a sprayed compositional layer at the condition of thermal treatment in oxidizing atmosphere, also forming simultaneously the specific macro- and micro-surface layer structure, which has a high adhesion strength to the substrate. Practical goal is achieved, within the known technique to obtain the compositional coating in which a porous coating is sprayed on the original substrate consisting of a metal oxide and a metallic binder and which, according to the proposed invention, employs as starting material for plasma spraying a powder mixture containing aluminum and/or titanium oxides, aluminum and/or titanium hydroxides, glass powder, and metallic aluminum and/or titanium as the metallic binder, in the composition range in weight % as shown:

| | |
|---|---|
| metallic aluminum and/or titanium | 1–7 |
| aluminum and/or titanium oxides | 0.1–12 |
| glass powder | 2–45 |
| aluminum and/or titanium hydroxides | remaining amount |

The powder particle size-dispersity must be:

| | |
|---|---|
| aluminum and titanium oxides | less than 30 microns |
| aluminum and titanium hydroxides | less than 20 microns |
| glass powder | less than 30 microns |
| aluminum and titanium | less than 50 microns |

During the plasma spraying process, aluminum and/or titanium powder is directed to the "hot" plasma beam zone i.e. through the annular space between plasmatron anode and the anode body, where it melts completely and is transported to the substrate where it forms a plastic intermediate layer over the sprayed substrate surface. Glass powder and aluminum and/or titanium oxides are directed to the "cold" plasma beam zone i.e. over the plasmatron cylinder cross-section at a distance (mm) according to the following empirical formula:

$$\gamma=(0.1–0.2)\ W,$$

where W is the power used in the spraying process (in kilowatts), and at an angle $\alpha$(in degrees) which is determined according to the empirical formula:

$$\gamma=(800–1500)\ W,$$

where W is the power used in the spraying process (in kilowatts). In addition, an apparatus is used which assures the removal of plasma's last portion and which is located at a distance of L from the substrate according to the empirical formula:

$$L\ (0.50–0.75)\ W,$$

where W is power (in kilowatts) used in the spraying process.

Glass powder and aluminum and/or titanium oxides melt only at the surface and are inserted into the intermediate layer over the substrate's surface consisting of aluminum and/or titanium, forming the microstructure of the surface layer of the coating. And finally, aluminum and/or titanium hydroxides, also directed to the "cold" plasma beam zone, go through the plasma beam practically without decomposing and deposit on the coating surface being formed.

It is necessary to point out that all previously described processes take place simultaneously and the coating separation into layers with higher amount of some components occurs because of the powder distribution according to their mass when passing through the plasma beam.

After that, the following thermal treatment taking place at a temperature range of 480–660° C. assures on one hand the relaxation of the remaining thermal stresses formed during the plasma spraying process, and on the other hand the chemical reactions in the sprayed materials.

As described earlier, the sprayed aluminum and/or titanium is additionally oxidized to aluminum and/or titanium oxides according to the reaction (II), aluminum and/or titanium oxidation takes place on the glass surface according to the exchange reaction (III), and sprayed aluminum and/or titanium hydroxide decomposes according to the reaction (I), forming aluminum and/or titanium oxide and water vapor.

Because the aluminum oxidation on glass particle surface process takes place in a temperature range of 520–580° C., essentially at a temperature range of 560–580° C., and aluminum hydroxide decomposition takes place in a temperature range of 480–660° C., where $\gamma$-modification aluminum oxide is formed at a temperature range of 480–560° C., and $\alpha$-modification aluminum oxide at a range 570–660° C., the optimal thermal treatment regimes are calculated to favor the formation of $\alpha$- and $\gamma$- modification oxides.

Because of the above considerations, the thermal treatment should be carried out at a temperature range 480–660° C. and, in addition, the duration of the thermal treatment should be 2–20 hours. As determined experimentally, it is important to maintain a heating rate below 100°/hour. Increase of this rate limit results in the formation of defective structures and, as its consequence, in the decrease of porosity.

EXAMPLE

The spraying of compositional coating was carried out on a 40 micron thick steel (X15 5 type) substrate. The powder composition used was based on aluminum hydroxide and its composition is shown below in weight %:

| | |
|---|---|
| aluminum oxide, particle size dispersity less than 19 microns | 3 |
| metallic aluminum, dispersity less than 30 microns | 5 |
| silicate glass powder, dispersity less than 30 microns | 7 |
| aluminum hydroxide, dispersity less than 10 microns | remaining amount. |

For spraying plasmatron PN-V1 was used with a separate powder components delivery and with a power source APR-403. Plasma formation gas used was atmospheric air. Spraying parameters: voltage—200 V, current—170 A, the cylinder cross-section distance from the substrate—100 mm.

The thickness of the deposited coating was 30 microns. The coating adhesion to the substrate after spraying was 25 kg/ sq.mm.

The thermal treatment of the compositional coating thus obtained took place in a SNOL type oven at 560° C. for 2 hours and it was cooled in the air.

X-ray structural analysis was carried out on a DRON-3 apparatus. The coating's structure after thermal treatment consisted of γ- modification aluminum oxide (the basis) with a small (less than 3%) amount of δ-, and traces of θ- and ξ-modifications.

The free surface area was measured employing a special sorbtometer. The free surface of the coating after the thermal treatment amounted to 65 sq.m./g.

Other properties and characteristics of obtained coatings are listed in Table 1.

num and titanium oxides compose like a coating's "skeleton" assuring its macroporosity, and the γ-modification aluminum oxide micro particles, formed in the sprayed coating as the result of the decomposition of intermediate hydroxide phases during the time of thermal treatment, assure the coating's microporosity and substantial increase of its surface area (up to 30–70 sq.m/g).

Examples 1–4 show the variation of powder composition during the plasma spraying onto a ceramic substrate, made from a high temperature resistant silicon ceramic.

In the examples 5–8, the variation of powder composition during the plasma spraying onto a metallic substrate is shown, for example, over is carried out without the previous preparation of foil surface.

In the examples 1, 2, 5 and 6, the oxide amount was within the minimal stated limits; in the examples 3, 4, 8, 9 and 10, it was close to the maximum. As evident from the Table 1, oxide and hydroxide ratio determines the magnitude of the free surface, which increases from 40–50 to 60–70 sq.m/g when the amount of hydroxides changes from 30 to 80–90%.

TABLE 1

| Position | Substrate | Aluminum Weight % | Glass Weight % | Aluminum Hydroxide Weight % | Titanium Hydroxide Weight % | Aluminum Oxide Weight % | Titanium Oxide Weight % | Coating Thickness μm | Adhesion Strength kg/mm$^2$ | Free Surface m$^2$/g |
|---|---|---|---|---|---|---|---|---|---|---|
| 1 | Ceramic | 1–3 | 2–5 | Remaining Amount | — | 1–3 | — | 30–40 (2–5) | >40 | 60–70 |
| 2 | Ceramic | 1–3 | 2–5 | — | Remaining Amount | — | 2–4 | 30–40 (2–5) | >40 | 40–50 |
| 3 | Ceramic | 1–3 | 2–5 | Remaining Amount | — | 10–12 | — | 30–40 (2–5) | >40 | 50–60 |
| 4 | Ceramic | 1–3 | 2–5 | — | Remaining Amount | — | 10–12 | 30–40 (2–5) | >40 | 40–50 |
| 5 | Stainless Steel | 3–7 | 5–20 | Remaining Amount | — | 1–13 | — | 20–30 (1–3) | >25 | 60–70 |
| 6 | Stainless Steel | 3–7 | 5–20 | — | Remaining Amount | — | 2–4 | 20–30 (1–3) | >25 | 40–50 |
| 7 | Stainless Steel | 3–7 | 5–20 | 50 | Remaining Amount | 1–3 | 2–4 | 20–30 (1–3) | >25 | 50–60 |
| 8 | Stainless Steel | 3–7 | 5–20 | Remaining Amount | — | 10–12 | — | 20–30 (1–3) | >25 | 50–60 |
| 9 | Stainless Steel | 3–7 | 5–20 | — | Remaining Amount | — | 10–12 | 20–30 (1–3) | >25 | 40–50 |
| 10 | Stainless Steel | 3–7 | 5–20 | 30 | Remaining Amount | 10–12 | 10–12 | 20–30 (1–3) | >25 | 50–60 |

High velocity plasma spraying in the air atmosphere, employing air as the plasma gas, was used. Coating components were delivered to various points of the plasma beam. After spraying the thermal treatment followed in the temperature range of 480–660° C.

During the spraying process aluminum particles melt when going through the plasma beam, glass powder particles melt at the surface, aluminum and titanium hydroxide particles do not decompose or decompose only partially to the intermediate phases, and aluminum oxide and titanium oxide particles become only hot. During transport of such particles to the substrate, the differentiation according to their mass takes place and, as a result, aluminum particles form a continuous very thin coating (less that 5μ) over the substrate's surface into which glass and oxide particles get incorporated and over which the hydroxide particles are distributed.

During the further thermal treatment process, a partial oxidation of the aluminum layer takes place, however a thin aluminum layer under the oxide layer retains its plastic properties i.e. practically has the properties of a normal plastic layer. In addition, the glass particles and also alumi- In addition, a partial or complete aluminum hydroxide substitution with titanium hydroxide decreases the free surface as a rule by 10–25 units.

As mentioned before, aluminum forms an underlayer over the substrate, forming an elastic bond between the substrate and the working layer and assuring a high adhesion strength, which is important in resisting the debonding when bending the substrate. Because the sprayed coating over a ceramic substrate does not require high resistance to bending (since the ceramic is very brittle), therefore the amount of metallic aluminum in the spray mixture over a ceramic is decreased as compared to a metallic substrate (1–3 as compared to 3–7%). The adhesive strength of the coating on a ceramic substrate in the examples 1–4 is no less than that of the ceramic itself and therefore when the samples with such coating are tested, the samples fail without delamination or intensive coating destruction. In such case, the open porosity controlled by the free surface area amounts to 50–70 sq.m/g.

The increase of the amount of aluminum in the sprayed layer over metallic substrates to 3–7% assures the increase of the adhesive strength of the sprayed layer compared to that of the substrate's strength. When testing by tensile or bending, the substrate failure takes place in all cases without delamination or intensive failure of the coating. This condition offers practically unlimited possibility to carry out the usual mechanical processing of the substrate with a sprayed coating. Our experiments have shown that the substrate can be mechanically cut, perforated, cold stamped, etc. All of these operations can be carried out without any damage to the coating. In order to obtain the required property level, the semi fabricate (it can be also a detail) obtained by the mechanical conversion must be only heated in air at a temperature range of 480–660° C.

The magnitude of the relative free surface is 60–70 sq.m/g for coatings based on aluminum oxide (Example 5) after spraying over a metallic substrate, 40–50 sq.m/g for titanium hydroxide based (Example 6), and 50–60 sq.m/g for hydroxide mixture based (Example 7) coatings. In this way, by changing the initial spraying composition, the spraying and subsequent mechanical treatment conditions, it is possible to obtain coatings with the required chemical and physico-mechanical properties.

Comparing the coating adhesion strength with the substrate to the prototype it is evident that the adhesion strength is higher by a decade.

The coating obtained by this technology can be further used for the deposition of metallic and polymeric anticorrosion coatings, for the deposition of antifrictional coatings, paint and lacquer coatings, thermal protection (thermal dissipation), for coatings with special properties, including catalytic coatings, and coatings for inorganic and organic synthesis, etc.

It has been experimentally determined, that aluminum oxide and titanium oxide exhibit qualitatively similar properties in the coatings and may be considered technically equivalent.

Although a preferred embodiment of the invention has been described above by way of example only, it will be understood by those skilled in the field that modifications may be made to the disclosed embodiment without departing form the scope of the invention, which is defined by the appended claims.

We claim:

1. A method of applying a porous coating to an initial substrate, in which a coating consisting of metal oxide and metal binder is deposited on the initial substrate by a technique of plasma spraying, whereby, as the raw material for the plasma spraying, a powder mixture is used, whereby the powder mixture contains aluminum oxide and/or titanium oxide powder and glass powder as the coating's micro structure forming materials; aluminum and/or titanium powder as metal-binder and aluminum hydroxide and/or titanium hydroxide powder as the material assuring the formation of the coating's micro structure and consisting of the following composition in weight percent:

| | |
|---|---|
| metallic aluminum and/or titanium | 1–7 |
| aluminum oxide and/or titanium oxide | 0.1–12 |
| glass powder | 2–25. |

2. A method according to claim 1, whereby all powder to be sprayed is divided into first and second groups, and delivered to separate plasma beam zones.

3. A method according to claim 2 wherein the first group consists of aluminum hydroxide and/or titanium hydroxide powder, aluminum oxide and/or titanium oxide powder and glass powder.

4. A method according to claim 3, wherein the first group's powder dispersity is:

| | |
|---|---|
| aluminum oxide and titanium oxides | less than 30 microns |
| aluminum hydroxide and titanium hydroxides | less than 20 microns |
| glass powder | less than 30 microns. |

5. A method according to claim 3, wherein the first group's powders are mixed in a disintegration apparatus, assuring the mutual mechanical surface alloying of the powder components.

6. A method according to claim 3, wherein the first group's powders are delivered through an annular space between a plasmatron's anode and anode's body.

7. A method according to claim 2, wherein the second group's powder consists of metallic aluminum and/or titanium powder.

8. A method according to claim 7, wherein the second group's powder dispersity is:

metallic aluminum and titanium less than 50 microns.

9. A method according to claim 7, wherein the second group's powders are delivered on a cross-section of a plasmatron tube.

10. A method according to claim 9, wherein the powder in the cross-section of the tube is delivered at a distance of $\gamma$ (in millimeters) from the end surface of the plasmatron according to the empirical formula:

$$\gamma=(0.1–2)\ W,$$

where W is the power (in kilowatts) used in the spraying process.

11. A method according to claim 9, wherein the powder is delivered in a direction opposite to that of a plasma flow at an angle $\alpha$ (in degrees) according to the empirical formula:

$$\alpha=(800–1500)\ W,$$

where W is the power (in kilowatts) employed in the spraying process.

12. The method as claimed in claim 7, wherein the plasma beam zone to which the second group of powders is delivered is hotter than the plasma beam zone to which the first group is delivered.

13. A method according to claim 1, wherein the substrate with the sprayed coating is thermally treated until the complete decomposition of intermediate and metastable phases obtained during the plasma spraying.

14. A method according to claim 13, wherein the thermal treatment is carried out in air at the temperature range of 480–660° C.

15. A method according to claim 13, wherein different in that the heating rate for the thermal treatment is not higher than 100° C. per hour.

16. The method as claimed in claim 1, wherein the powder to be sprayed is directed into a plasma beam, and a last portion of the plasma beam is diverted at a plasma beam diversion point before reaching the substrate, whereby the effect of heat on the substrate is reduced.

17. The method as claimed in claim 16, wherein a distance L (in millimeters) from the plasma beam diversion point to the substrate which is being sprayed is determined by the empirical formula:

$$L=(0.50–0.75)W,$$

where W (in kilowatts) is the power used during spraying.

* * * * *